US007704039B1

(12) United States Patent
Liang

(10) Patent No.: US 7,704,039 B1
(45) Date of Patent: Apr. 27, 2010

(54) BOAS WITH MULTIPLE TRENCHED FILM COOLING SLOTS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 595 days.

(21) Appl. No.: 11/726,335

(22) Filed: Mar. 21, 2007

(51) Int. Cl.
*F01D 11/08* (2006.01)

(52) U.S. Cl. ..... 415/116; 415/173.1

(58) Field of Classification Search ..... 415/173.1
See application file for complete search history.

(56) References Cited

U.S. PATENT DOCUMENTS

| | | | | |
|---|---|---|---|---|
| 2,685,429 | A | | 8/1954 | Auyer |
| 4,497,610 | A | | 2/1985 | Richardson et al. |
| 4,526,226 | A | | 7/1985 | Hsia et al. |
| 4,679,981 | A | | 7/1987 | Guibert et al. |
| 5,048,288 | A | | 9/1991 | Bessette et al. |
| 5,169,287 | A | | 12/1992 | Proctor et al. |
| 5,584,651 | A | | 12/1996 | Pietraszkiewicz et al. |
| 5,601,402 | A | | 2/1997 | Wakeman et al. |
| 5,649,806 | A | * | 7/1997 | Scricca et al. ..... 415/116 |
| 5,993,150 | A | | 11/1999 | Liotta et al. |
| 6,139,257 | A | | 10/2000 | Proctor et al. |
| 6,155,778 | A | | 12/2000 | Lee et al. |
| 6,354,795 | B1 | | 3/2002 | White et al. |
| 6,508,623 | B1 | | 1/2003 | Shiozaki et al. |
| 6,779,597 | B2 | | 8/2004 | DeMarche et al. |
| 6,899,518 | B2 | | 5/2005 | Lucas et al. |
| 6,905,302 | B2 | | 6/2005 | Lee et al. |

* cited by examiner

*Primary Examiner*—Richard Edgar
(74) *Attorney, Agent, or Firm*—John Ryznic

(57) ABSTRACT

A blade outer air seal for use in a gas turbine engine, the BOAS including a plurality of first diffusion and impingement cooling air cavities separated by stiffener ribs, each diffusion and impingement cavity being connected to a cooling air supply cavity through a first metering and impingement hole. Each diffusion and impingement cavity is connected to a plurality of trenched diffusion slots that open onto the surface of the BOAS and form a series of V-shaped slots. A plurality of second metering and impingement holes connect each slot to the respective first diffusion and impingement cavity. The trenched diffusion slots are angularly offset from a normal direction to the BOAS surface, and the second metering and impingement holes are offset at about 90 degrees from the slots so that both diffusion and impingement cooling occurs within the slots. The array of separated diffusion and impingement cavities and metering holes allow for the cooling flows and pressures to be regulated for each area of the BOAS.

13 Claims, 3 Drawing Sheets

View A-A

View B-B

BOAS WITH MULTIPLE TRENCHED FILM COOLING SLOTS

BACKGROUND OF THE INVENTION

1. Field of the Invention

The present invention relates generally to a gas turbine engine, and more specifically to a blade outer air seal and the cooling thereof.

2. Description of the Related Art Including Information Disclosed Under 37 CFR 1.97 and 1.98

A gas turbine engine includes a compressor to deliver a compressed air to a combustor, the combustor combines the compressed air with a fuel to produce a high temperature gas flow, and a turbine that receives the hot gas flow and converts the high temperature flow into mechanical energy to drive a rotor shaft. The efficiency of the gas turbine engine can be improved by increasing the temperature of the flow into the turbine. Prior art turbines include stationary vanes and rotor blades made of high temperature resistant materials in order to maximize the temperature exposure to these parts. Complex cooling circuit are used in the first stage rows of vanes and blades in order to provide cooling such that these parts can be exposed to even higher temperatures that would normally melt the parts.

Another method of increasing the efficiency of the gas turbine engine is to reduce the flow leakage between the rotor blade tips and the shroud casing that forms the blade gap. A plurality of shroud segments that form an annular shroud is fixedly joined to the stator casing and surrounds the rotor blades. The shroud segments are suspended closely atop the blade tips to provide for a small gap or tip clearance between the shroud and the blade tip. In order to reduce the flow leakage across the tip clearance, the tip clearance should be as small as possible to provide for an effective fluid seal during engine operation for minimizing the hot gas flow leakage. However, because the rotor disk and blade have a different thermal expansion and contraction that the casing and shroud segments, the blade tips occasionally rub against the inner surface of the shroud segments and cause abrasion.

The blade tips are directly exposed to the hot gas flow and are difficult to cool properly. The life of the blade is therefore limited because of this difficulty in cooling the tips. Also, when the blade tips rub against the surrounding shroud segments, the blade tips and shroud segments are additionally heated by the friction which also affects the blade useful life. The friction heat generated during a blade tip rub further increases the radial expansion between the tips and the shroud segments, and therefore further increases the severity of the blade tip rub.

Since the shroud segments are also exposed to the hot gas flow through the turbine, the shroud segments are also cooled. Prior art turbine shrouds are cooled by passing cooling air onto the outer surface for impingement cooling to provide backside convective cooling. In addition, film cooling holes are formed in the shroud segments to pass cooling air onto the inner surface of the shroud on which the hot gas flow is exposed. Higher efficiency cooling mechanism such as external film cooling technique has not been widely used in the cooling design. This is primary due to film cooling slots being subject to smear by the passing blade row against the BOAS. Subsequently it loses film cooling capability and shuts off the cooling flow. As a result, over temperature or burn through for the BOAS occurs due to the blade rubbing effect.

Since blade tip rub is unavoidable for maximizing efficiency of the engine, both the turbine shrouds and the blade tips are subject to abrasion wear. U.S. Pat. No. 6,155,778 issued to Lee et al on Dec. 5, 2000 entitled RECESSED TURBINE SHROUD as represented in FIG. 1 discloses a shroud segment used in a gas turbine engine, in which the shroud segments include an inner surface (#50 in this patent) exposed to the hot gas flow, a plurality of recesses (#62 in this patent) opening onto the inner surface 50, and cooling holes to supply cooling air from above the shroud to the recesses 62 to provide film cooling to the shroud inner surface. The recesses 62 are provided for the purpose disclosed in the Lee et al patent for reducing surface area exposed to the blade tips so that during a blade tip rub with the shroud, reduced rubbing of the blade tip with the shroud occurs for correspondingly decreasing frictional heat in the blade tip (see column 3, lines 60-66).

The prior art backside convective cooling used in blade outer air seal (BOAS) cooling design provides cooling to the shroud, but does not provide cooling to the inner shroud surface or the blade tips. Higher efficiency cooling mechanism such as external film cooling has not been widely used in the cooling design. This is primary due to film cooling slots being subject to smear by the passing blade row against the BOAS. Subsequently, it loses film cooling capability and shuts off the cooling flow. As a result, over-temperature or burn out for of the BOAS occurs due to the blade rubbing.

It is therefore an object of the present invention to provide for improved cooling of the shroud segments in a gas turbine engine in order to require less cooling air to provide adequate cooling for the shroud and therefore improve engine efficiency.

It is another object of the present invention to provide for less heat generation due to blade tip to shroud rubbing, and therefore extend the useful life of the rotor blades and shroud segments in the gas turbine engine.

It is another object of the present invention to provide cooling for a BOAS that utilizes both backside multi-impingement compartment cooling and multi-metering plus diffusion cooling for the entire blade outer air seal hot surface.

Another object of the present invention is to provide for a BOAS cooling arrangement in which blade rub will not cause plugging of the cooling holes by the passing blade row against the BOAS.

BRIEF SUMMARY OF THE INVENTION

A blade outer air seal (BOAS) used in a gas turbine engine, the BOAS having a film cooling slot construction that uses both backside multi-impingement compartment cooling and multi-metering plus multiple diffusion cooling slot mechanism for cooling the BOAS. The BOAS includes a metering and impingement plate welded onto stiffener ribs that form a grid arrangement of compartments with first metering and impingement holes leading into each compartment. Second metering and diffusion holes lead from each compartment into film slots that extend along the bottom surface of the BOAS facing the blade tip. The film slots or trenches extend at angles offset from the rotational direction of the blade tip in a chevron formation. The cooling air from a supply cavity passes through the first metering and impingement holes and into the individual compartments. The first impingement cooling air diffuses within the compartments and then flows through the second metering and diffusion holes and into the trenches for additional impingement cooling and diffusion. By using the individual compartments, each compartment can have the cooling air flow regulated by modifying the metering hole. The combined cooling effects provide for a passive tip clearance control, greatly reduces the BOAS main body metal temperature, and improves the durability of the abrasive thermal barrier coating, resulting in a reduction of the cooling flow requirement, improved turbine stage performance, and prolonged BOAS life.

DETAILED DESCRIPTION OF THE INVENTION

Figure 1:
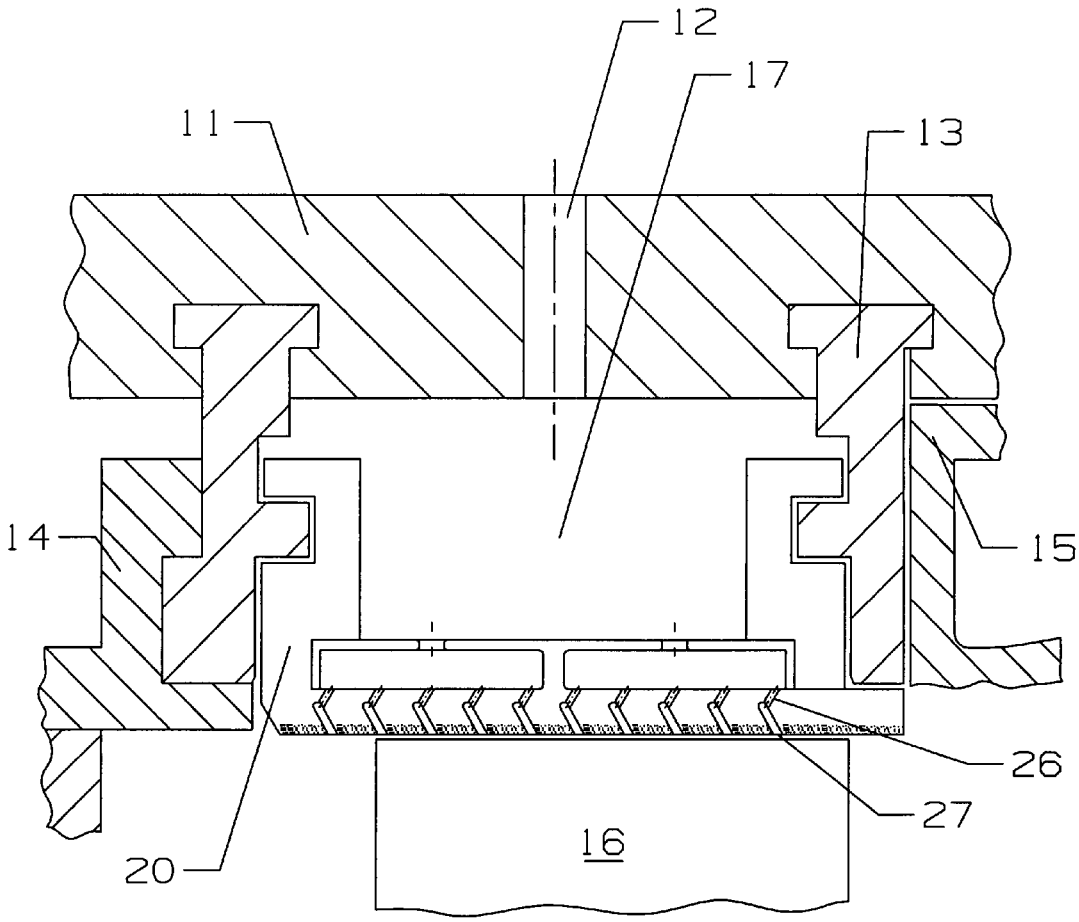
FIG. 1 shows a cross section of a BOAS within a stage of a gas turbine engine with the cooling flow arrangement of the present invention.

The present invention is a blade outer air seal (BOAS) with a cooling circuit that includes backside multi-impingement compartment cooling and multi-metering plus multiple diffusion cooling slots for cooling the entire blade outer air seal hot surface. FIG. 1 shows the BOAS of the present invention used in a stage of a gas turbine engine. A blade ring carrier 11 includes a cooling supply hole 12 to channel compressed cooling air from, for example, the compressor. Two isolation rings 13 extend from the blade ring carrier 11 and support the blade outer air seal 20. An upstream stator vane 14 is also supported by the upstream isolation ring 13 while a downstream vane 15 is supported by the downstream isolation ring 13. A cooling air supply cavity 17 is formed between the isolation rings 13, the blade ring carrier 11, and the BOAS 20. The BOAS includes an inner surface with a thermal barrier coating (TBC) applied to the bottom surface facing a tip of a rotor blade 16.

Figure 2:
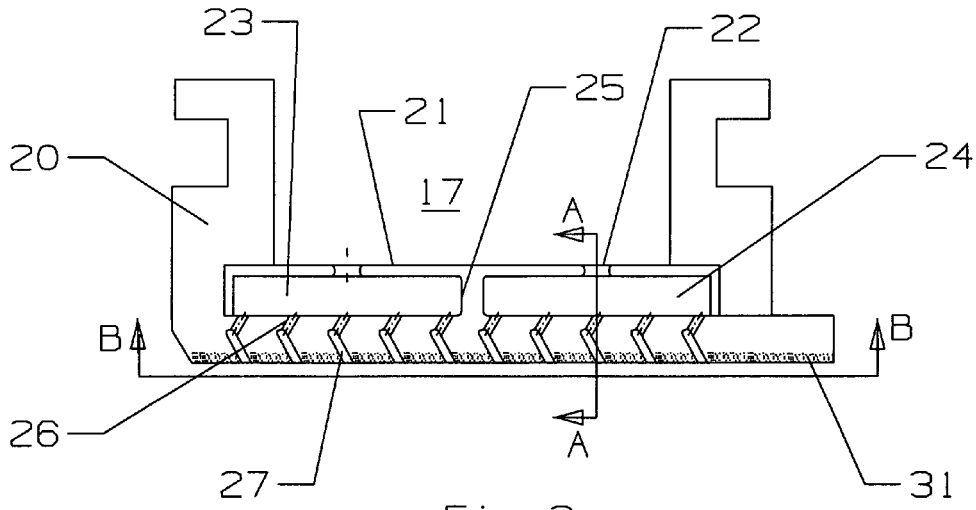
FIG. 2 shows a detailed cross section view of the BOAS of the present invention.

FIG. 2 shows a detailed view of the BOAS of that shown in FIG. 1. The BOAS 20 includes stiffener ribs 25 extending from the bottom surface in which the ribs are arranged in a rectangular array to form a grid of compartments 24. Each of the compartments 24 forms a first diffusion cavity and also a first impingement cavity. A metering plate 21 is bonded to the stiffener ribs 25 to form the individual compartments 24 between the ribs 25. First metering holes 22 are formed on the metering plate 21 leading into each compartment 24. Each compartment 24 is connected to a plurality of second metering holes 26 that are offset about 45 degrees from the axis of the first metering holes 22. Each of the second metering holes 26 opens into a trenched diffusion slot 27 that is also offset from the axis of the first metering hole 22 but on the opposite side from the offset of the second metering holes 26. The trenched diffusion slots 27 extend from the bottom of the slot to the top or opening on the BOAS surface at a direction offset from the normal (perpendicular) to the BOAS bottom surface. This is shown clearly in FIG. 3 in which the trenched slots extend at about 45 degrees from a direction perpendicular to the bottom surface of the BOAS. The angles of the second metering holes 26 and the diffusion slots 27 allow for the cooling air to impinge within the diffusion slots. Each of the trenched diffusion slots 27 is connected to a row of second metering and impingement cooling holes 26. A TBC 31 is applied on the lower or bottom surface of the BOAS facing the blade tip.

Figure 3:
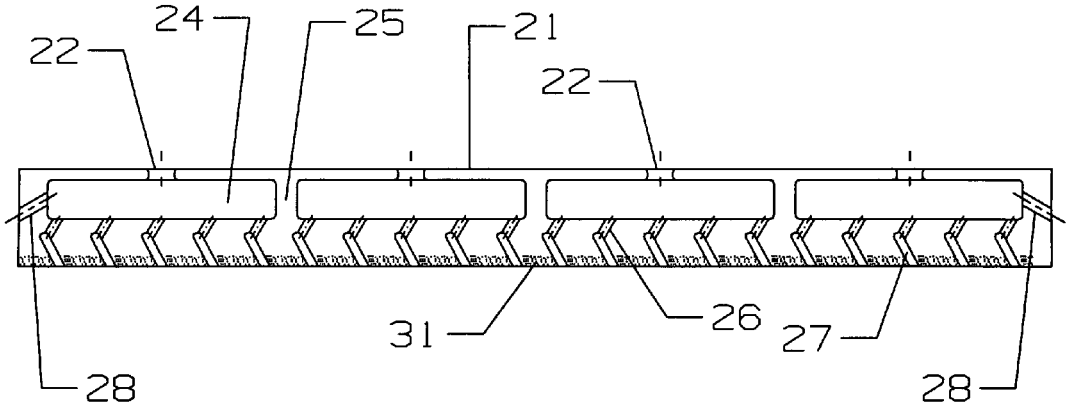
FIG. 3 shows a cross section view of the BOAS of FIG. 2 taken through the direction A-A.

FIG. 2 shows the BOAS with the left side being the leading edge side and the right side being the trailing edge side in the direction of the hot gas flow through the engine. In this direction of hot gas flow passage, two compartments are formed: a forward compartment on the leading edge side and an aft compartment on the trailing edge side. FIG. 3 shows a cross section of the BOAS through the aft compartment in FIG. 2 on the trailing edge side. Four compartments are formed in each BOAS segment in this circumferential direction through the stage of the engine. On the sides or end rails of the BOAS are formed mate face cooling holes 28 that discharge cooling air from the associated compartment and against the adjacent BOAS mate face.

Figure 4:
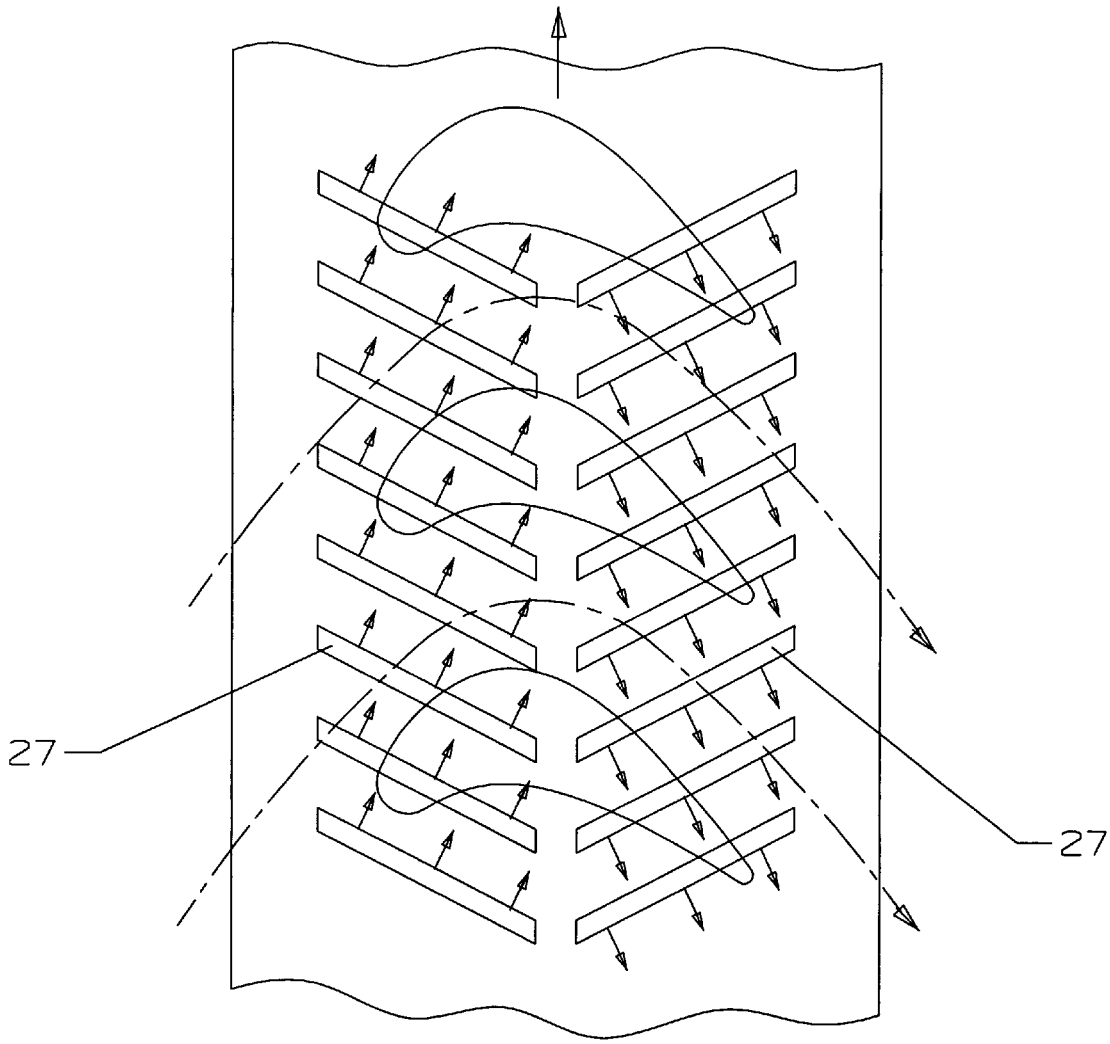
FIG. 4 shows a bottom view of the BOAS taken along lines B-B in FIG. 2.

The diffusion slots 27 are trenched instead of being film cooling holes so that blade tip rub will not block and of the holes. The trenched diffusion slots 27 that open onto the bottom surface of the BOAS are angled with respect to the rotational direction of the blade tip as seen in FIG. 4 and form a V-shape with the opening of the V being in the direction of the arrow representing the direction of the blade tip rotation as seen in FIG. 4. Two adjacent slots forming the V-shape are not connected at the middle but are separated such that cooling air from one slot does not communicate with the other slot before the cooling air is discharged from the slots. The blades are shown in the dashed lines and the rotational direction of the blade is represented by the arrow in FIG. 4. The left side of this figure is the leading edge side, while the right side of the figure is the trailing edge side. The trenches 27 on the leading edge side and the trailing edge side of the BOAS are slanted as shown. The leading edge side trenches are slots that open to the "up-right" direction. The trenches on the trailing edge side are slots that open pointed to the down direction. The cooling air in the leading edge side trenches flows toward the blade rotational direction while the cooling air in the trailing edge trenches flows against the blade rotational direction as shown by the arrows in FIG. 4.

In operation, cooling air is supplied through the blade ring carrier 11 via the cooling supply holes 12 and into the cooling air supply cavity 17. The amount of cooling air for each individual compartment 24 is sized based on the local gas side heat load and pressure. This regulates the local cooling performance and metal temperature. The cooling air is then metered through the substrate backing material, impinging onto the backside of the BOAS, diffusing into each individual diffusion compartment chamber 24. With the cooling construction of the present invention, the usage of cooling air for a given BOAS inlet gas temperature and pressure profile is maximized. The spent cooling air is then metered and impinged into the continuous trenched diffusion slots. The spent cooling air is then discharged onto the BOAS hot surface to provide a precise located film layer. Optimum cooling flow utilization is achieved with this BOAS cooling construction.

The stiffener ribs used on the back side of the blade outer air seal backing substrate transform the BOAS into a grid panel configuration. A metering plate is welded onto the stiffener ribs to transform the grid panel into multiple compartments. Impingement holes at various size and number are utilized in the BOAS substrate corresponding to each individual compartment. The multi-compartment and multi-metering diffusion trenched slots cooling construction utilizes the multi-hole impingement cooling technique for backside convective cooling as well as flow metering purposes. The cooling air is metered in each individual cooling compartment allowing for the cooling air to diffuse uniformly into the compartmented diffusion chambers, and then metering and diffusion into the continuous trenched shaped film cooling slots which reduces the cooling air exit momentum. Coolant penetration into the gas path is thus minimized, yielding good build-up of the coolant sub-boundary layer next to the BOAS surface and better film coverage in the stream-wise and circumferential directions for the BOAS. the combination effects of multi-hole impingement cooling plus diffusion slot film cooling at very high film coverage yields a very high cooling effectiveness and uniform wall temperature for the BOAS structure. In addition, the impingement metering hole is located inside of the continuous V-grooved diffusion film discharge slot to avoid smear by the passing blade row against the BOAS. also, the trenched slots can be oriented in the formation of perpendicular or against with the hot flow gas stream path against the secondary leakage flow which provides a passive tip clearance control for the blade stage. This reduces the blade leakage flow and improves stage performance. Abrasive thermal barrier coating is applied onto the external surface of the BOAS surface for further tip clearance control.

I claim:

1. A blade outer air seal for use in a gas turbine engine, comprising:

a trenched diffusion slot extending along and opening onto the BOAS lower surface;

a metering hole in fluid communication with a cooling air supply cavity of the BOAS and opening into the trenched diffusion slot, the metering hole being oriented with the trenched diffusion slot such that both diffusion and impingement cooling of the slot occurs; and, the trenched diffusion slot is offset at about a 45 degree angle from a perpendicular direction from the BOAS bottom surface.

2. The blade outer air seal of claim 1, and further comprising:

the metering hole and the trenched diffusion slot form around a 90 degree angle with respect to each other.

3. A blade outer air seal for use in a gas turbine engine comprising:

a main body segment including a surface on which a TBC is applied;

a plurality of stiffener ribs forming a plurality of first diffusion and impingement cavities in the forward and aft direction and in the circumferential direction of the BOAS;

a metering plate covering the plurality of first diffusion and impingement cavities;

a first metering and impingement hole formed in the metering plate for each of the plurality of first diffusion and impingement cavities, the first metering and impingement holes connecting the cavities to a cooling air supply cavity;

each of the first diffusion and impingement cavities connected to a plurality of trenched diffusion slots opening onto the surface of the BOAS through a second metering and impingement hole; and, the trenched diffusion slots are angled with respect to the surface of the BOAS and the second metering and impingement holes are angled with respect to the trenched diffusion slots such that cooling air passing from the cavity and out from the slot is diffused and impinged into the slot.

4. The blade outer air seal of claim 3, and further comprising:

a plurality of forward trenched diffusion slots and a plurality of aft trenched diffusion slots having a V-shaped arranged looking from the bottom surface of the BOAS in which the two slots are separated at around the middle of the BOAS surface.

5. The blade outer air seal of claim 4, and further comprising:

the V-shaped arrangement of trenched diffusion slots opens in the direction of rotation of the blade tip.

6. The blade outer air seal of claim 5, and further comprising:

the forward trenched diffusion slot discharges the cooling air in a direction toward the blade tip rotation, and the aft trenched diffusion slot discharges the cooling air in a direction opposed to the blade tip rotation such that the cooling air discharged from the slots is directed substantially in the direction of the hot gas flow through the BOAS.

7. The blade outer air seal of claim 3, and further comprising:

an end rail in the circumferential direction of the BOAS includes a mate face cooling hole in communication with the adjacent diffusion and impingement cavity to discharge cooling air to a mate face of an adjacent BOAS.

8. The blade outer air seal of claim 3, and further comprising:

the BOAS includes at least four cavities in the circumferential direction and at least two cavities in the forward to aft direction of the BOAS.

9. A blade outer air seal for use in a gas turbine engine, comprising:

a trenched diffusion slot extending along and opening onto the BOAS lower surface, the trenched diffusion slot being angularly offset from a normal direction of the BOAS bottom surface;

a metering hole in fluid communication with a cooling air supply cavity of the BOAS and opening into the trenched diffusion slot, the metering hole being oriented with the trenched diffusion slot such that both diffusion and impingement cooling of the slot occurs;

a metering plate with a first metering and impingement hole connecting the first diffusion and impingement cavity to the cooling air supply cavity, whereby cooling air from the cooling air supply cavity is metered through the first metering and impingement hole into the first diffusion and impingement cavity to provide impingement cooling to the BOAS, and then the cooling air flows through the metering hole that opens into the trenched diffusion slot and into the trenched diffusion slot to provide further impingement cooling to the BOAS; and, a plurality of trenched diffusion slots arranged substantially parallel to each other, each slot being connected to the first diffusion and impingement cavity through a plurality of metering holes that opens into the trenched diffusion slot.

10. A blade outer air seal for use in a gas turbine engine, comprising:

a trenched diffusion slot extending along and opening onto the BOAS lower surface, the trenched diffusion slot being angularly offset from a normal direction of the BOAS bottom surface;

a metering hole in fluid communication with a cooling air supply cavity of the BOAS and opening into the trenched diffusion slot, the metering hole being oriented with the trenched diffusion slot such that both diffusion and impingement cooling of the slot occurs;

an array of first diffusion and impingement cavities each connected to a metering hole that opens into a trenched diffusion slot;

the array of first diffusion and impingement cavities is covered by a metering plate that includes at least one first metering and diffusion hole to connect the cooling air supply cavity to each of the first diffusion and impingement cavities; and, a plurality of trenched diffusion slots arranged substantially parallel to each other, each slot being connected to the first diffusion and impingement cavity through a plurality of the metering holes that open into the trenched diffusion slot, whereby a plurality of slots and metering holes that open into the trenched diffusion slot are connected to each of the diffusion and impingement cavities such that each diffusion and impingement cavity provides cooling air to a plurality of trenched diffusion slots.

11. The blade outer air seal of claim 9 or 10, and further comprising:

a forward trenched diffusion slot and an aft trenched diffusion slot having a V-shaped arranged looking from the bottom surface of the BOAS in which the two slots are separated at around the middle of the BOAS surface.

12. The blade outer air seal of claim 11, and further comprising:

the V-shaped arrangement of trenched diffusion slots opens in the direction of rotation of the blade tip.

13. The blade outer air seal of claim 12, and further comprising:

the forward trenched diffusion slot discharges the cooling air in a direction toward the blade tip rotation, and the aft trenched diffusion slot discharges the cooling air in a direction opposed to the blade tip rotation such that the cooling air discharged from the slots is directed substantially in the direction of the hot gas flow against the BOAS.

* * * * *